United States Patent [19]

Svoboda

[11] 4,288,094

[45] Sep. 8, 1981

[54] SAFETY SKI BINDING

[75] Inventor: Josef Svoboda, Schwechat, Austria

[73] Assignee: TMC Corporation, Baar, Switzerland

[21] Appl. No.: 13,473

[22] Filed: Feb. 21, 1979

[30] Foreign Application Priority Data

Feb. 20, 1978 [AT] Austria ..... 1192/78

[51] Int. Cl.[3] ..... A63C 9/08

[52] U.S. Cl. ..... 280/623; 280/634

[58] Field of Search ..... 280/617, 636, 633, 618, 280/611, 631, 630, 629, 632, 623, 625, 634

[56] References Cited

U.S. PATENT DOCUMENTS

| | | | |
|---|---|---|---|
| 3,733,082 | 5/1973 | Murata et al. | 280/632 |
| 3,788,660 | 1/1974 | Smolka et al. | 280/632 |

FOREIGN PATENT DOCUMENTS

| | | | |
|---|---|---|---|
| 2200768 | 7/1972 | Fed. Rep. of Germany | 280/626 |
| 2429610 | 1/1976 | Fed. Rep. of Germany | 280/628 |
| 1454508 | 8/1966 | France | 280/623 |
| Ad.94846 | 10/1969 | France | 280/629 |

*Primary Examiner*—Joseph F. Peters, Jr.
*Assistant Examiner*—Milton L. Smith
*Attorney, Agent, or Firm*—Blanchard, Flynn, Thiel, Boutell & Tanis

[57] ABSTRACT

A safety ski binding having a front jaw and a rear jaw, wherein at least the rear jaw is movably guided in longitudinal direction of the ski and is intitially resiliently biassed toward the ski boot. A stop is operatively associated with the rear jaw for limiting the movement of the rear jaw in direction toward the tail of the ski. The front jaw is movably guided against a spring force in direction toward the tip of the ski.

5 Claims, 4 Drawing Figures

SAFETY SKI BINDING

FIELD OF THE INVENTION

The invention relates to a safety ski binding comprising a front and rear jaw, wherein at least the rear holding part for the ski boot, namely the rear jaw, is movably guided in longitudinal direction of the ski and is initially resiliently tensioned toward the boot.

BACKGROUND OF THE INVENTION

In known ski bindings, the rear jaw is usually movably guided on a carriage in a direction parallel to the longitudinal axis of the ski and is initially tensioned toward the boot by a pressure spring. During insertion of the ski boot into the binding, the rear jaw is moved toward the tail of the ski against the force of the pressure spring. This assures a secure holding of the ski boot in the ski binding and compensates for possible inexactnesses during the adjustment of the binding to the ski boot size. However, this construction has the disadvantage that a further shifting of the rear jaw occurs during skiing through depressions, namely when the ski is flexed, which results in a change in the release values of the spring biassed components. This occurs on the one hand due to the increased friction between the ski boot and the jaw. On the other hand, the pressure spring and the release spring which determines the release force are coupled primarily with one another, so that the release values are increased.

Therefore, rear jaws have been developed, in which the release force is independent of the shifting movement of the rear jaw. However, this solution is not satisfactory because the increase of the release force for both the front jaw and the rear jaw, due to the increased frictional engagement of the ski boot with the jaws, cannot be compensated for.

A further problem of such ski bindings consists in many falls occurring when the skier's body is positioned close to the ski, namely when the skier is in a squatting position to minimize the air resistance. In skiing toward an obstacle in this position, for example a snow hill, a relatively small release moment is created. The release values of the rear jaw, which are adjusted to the normal upright position of the body, are thus not attained and the ski boot cannot release from the ski binding.

Thus it has become known to support the front jaw on a carriage which is movable in longitudinal direction of the ski in order to reduce the danger of injury during frontal falls. The front jaw is moved forwardly against the force of a spring during insertion of the ski boot into the binding. When the skier's ski hits a frontal obstacle, the front jaw will slide further forwardly so that the ski boot can be removed from the heel mounting. However, this solution cannot be identified as an optimum solution, because a clearly defined position of the tip of the boot is not determined, or a guiding of the ski is very inexact, because due to the practically floating support of the ski boot, the position thereof will constantly change during skiing.

Therefore, the basic purpose of the invention is to provide a ski binding which permits as usual a fixed and exactly determined position of the ski boot on the ski and avoids the disadvantages during skiing or during frontal impact with an obstacle, namely avoids an increase in the release force of the ski binding components.

The invention provides for this a stop which is associated with the rear jaw to limit the path of movement of the rear holding part of the rear jaw in a direction toward the tail of the ski, and the front holding part or in a conventional manner the front jaw is movably guided against a spring force in a direction toward the tip of the ski.

The adjustment of the ski binding can therewith be selected such that the ski boot effects in inserted condition a shifting of the rear jaw or of the rear holding part until it engages the stop. Thus the ski boot remains even during a flexing of the ski in a fixed position because in this case the rear jaw is stationarily supported at the stop and the front jaw is moved. It is particularly preferable if the front holding part or the front jaw is initially tensioned against a stop toward the tip of the ski boot.

The pushing force of the front and the rear jaw is dimensioned such that preferably the spring force of the rear jaw, which spring force acts toward the heel of the ski boot, is smaller during movement of the rear jaw in the region of its stop than the spring force of the front jaw, which spring force acts toward the toe of the ski boot.

In a preferable exemplary embodiment of the invention, an abutment for at least one release spring of the rear jaw, which is constructed as a release jaw, is connected to a base plate which is secured or fixed to the ski, wherein the spring tension of the release spring is reduced during a shifting of the rear jaw or of the holding part toward the boot.

This construction has the advantage of, when the skier hits an obstacle, moving the front jaw and the rear jaw toward the tip of the ski to effect a relaxing of the release spring of the rear jaw, namely the release force of the same is reduced. Thus, already a substantially smaller forward tipping moment of the skier is sufficient to release the ski boot. This is an important advantage particularly during skiing in the squatting or streamlined position or during falls in the squatting position.

It is furthermore preferred if an abutment member for at least one release spring of the front jaw, which is constructed as a release jaw, is arranged on a base plate which can be secured or fixed to the ski, wherein the spring tension of the release spring is reduced during shifting of the front jaw in a direction toward the tip of the ski.

Thus this effect can also be achieved for the front jaw during a release which occurs typically for twisting falls or torsional stresses on the leg.

The inventive measures can practically be applied to all common front and rear jaws or release systems.

The invention will be discussed more in detail hereinafter with reference to one exemplary embodiment and referring to the figures in the drawing; however, the illustrated structure is not to be limiting.

DETAILED DESCRIPTION

Figures 1, 2, 3, 4:
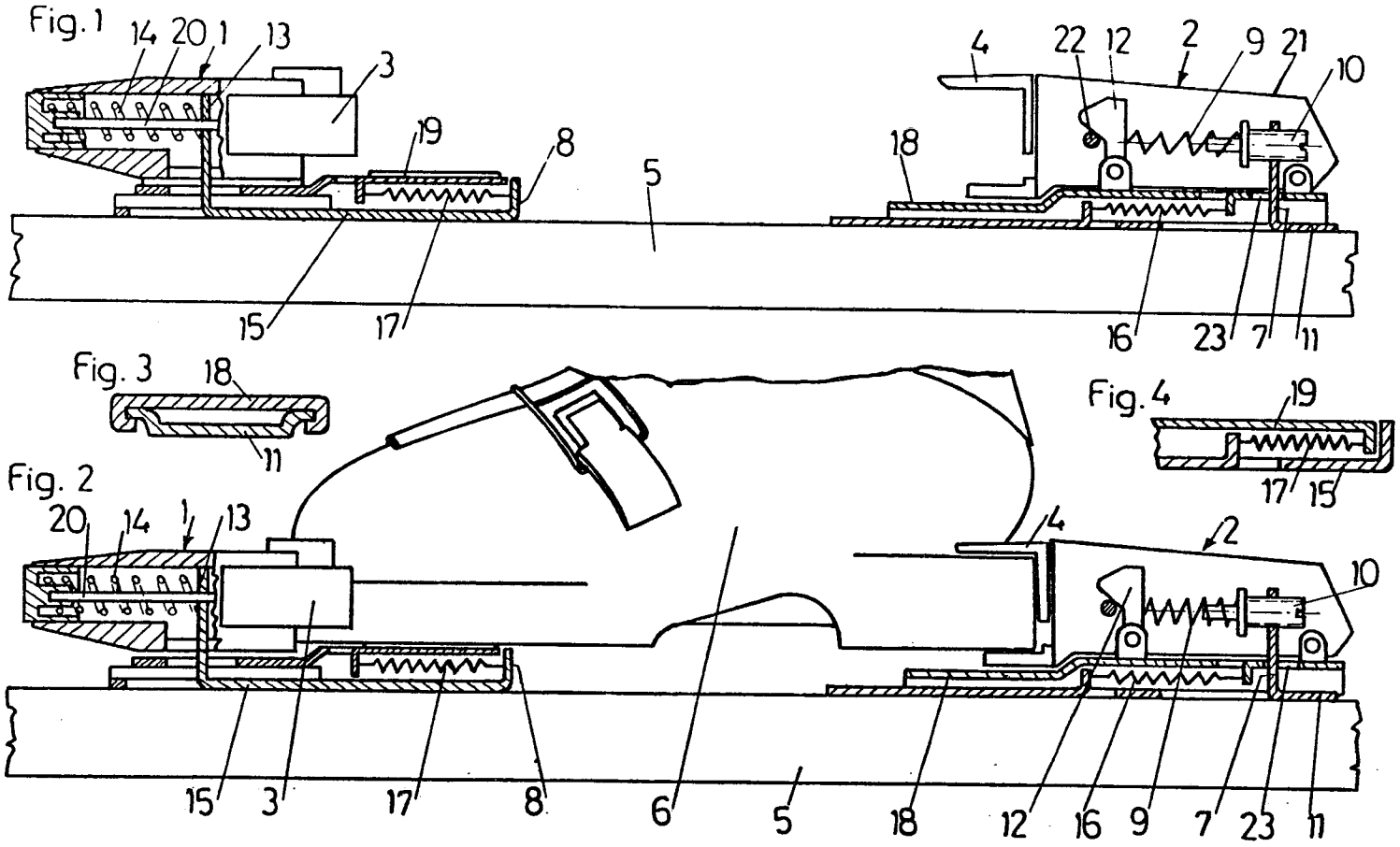
FIG. 1 illustrates a central longitudinal cross section of the inventive ski binding.
FIG. 2 illustrates the ski binding when the ski boot is inserted therein.
FIG. 3 illustrates a cross section of the support for the rear jaw.
FIG. 4 illustrates an exemplary embodiment of the support for the front jaw.

As is illustrated in FIG. 1, a base plate 15 for the front jaw and a base plate 11 for the rear jaw are mounted on the ski 5. Carriages 18 and 19 for the two jaws are supported on the base plates 11 and 15, respectively, and are movable in longitudinal direction of the ski. The rear jaw 2 has a housing 21 which is connected to the carriage 18 and is supported for pivotal movement in an upward direction about an axle. The rear holding part 4 for the sole of the ski boot is mounted on the housing 21. The housing 21 has a release mechanism therein which permits an upward pivotal movement to occur caused by the application of a predetermined release force thereto by the ski boot to effect a release of the ski boot. The release mechanism can be any one of numerous different known systems. A control cam 12 is utilized in the present case, which cam is urged against a pin 22 of the housing 21 by a release spring 9. The end of the release spring 9 remote from the cam 12 is supported on an adjustable abutment member 10 which is connected to a fixed stop 7 on the base plate 11. The abutment member 10 is constructed as a screw, through an adjustment of which the initial tension of the release spring can be adjusted. The carriage 18 is connected through a pressure spring 16, which is constructed as a tension spring, to an abutment on the base plate 11. In addition, a hole 23 is provided in the carriage 18 and receives the stop 7 therein. Thus, the rear jaw 2 is movable in a direction toward the tail of the ski against the force of the spring 16 until it engages the stop 7.

The carriage 19 for the front jaw 1 is connected through a pressure spring 17, which is also constructed as a tension spring, to the base plate 15 and is biassed into engagement with a stop 8 by the spring 17. Different known release mechanisms are utilizable for the torsion release of the front jaw 1. In the present case, the front holding part 3 for the ski boot 6 consists of two elements which yieldingly hold the ski boot against lateral movement, which elements are each pivotal upon an overload about separate axles which are not shown and which extend perpendicularly with respect to the upper surface of the ski. The release force is applied through a power-transmitting rod 20 by a release spring 14. An abutment 13 is provided for one end of the release spring 14 and is connected to the base plate 15. The other end of the release spring engages a support member on the front jaw. During a movement of the carriage 18 of the rear jaw 2 or the carriage 19 of the front jaw 1, the associated release springs 9 or 14 will relax, which causes the release force to be reduced.

FIG. 2 illustrates the position of the toe and heel jaws when the ski boot 6 is inserted therein in the normal downhill skiing position. The rear jaw 2 and the carriage 18 are caused to move into engagement with the stop 7. The release force of the release spring 9 is then adjusted to the predetermined value for the normal skiing position of the skier. The pressure spring 17 for the front jaw 1 is dimensioned such that a movement of the front jaw or the carriage 19 toward the tip of the ski will not yet occur. If the skier now travels through a depression and the tip and tail portions of the ski are bent or flexed upwardly, then the distance between the front and rear jaws is shortened and the front jaw 1 is moved toward the tip of the ski. Due to this movement, the release spring 14 of the front jaw is relaxed, namely the release force which is needed for a torsion release is reduced. The increased frictional resistance of the tip of the ski boot engaging the toe jaw can therewith be balanced. If the skier skis against a frontal obstacle, for example against a snow hill, then the front jaw 1 will shift toward the tip of the ski. The rear jaw 2 will follow this movement. The release spring 9 of the rear jaw will be relaxed by this movement. Thus, a release of the rear jaw will occur during a substantially smaller forward tipping moment, which occurs, for example, during skiing in the squatting position.

FIG. 3 illustrates a cross-sectional view of the movable guideway for the carriage 18 on the base plate 11.

FIG. 4 illustrates a detail of the pressure spring 17 urging the carriage 19 for the front jaw toward the ski boot. Of course, it is possible to adjust the spring tension with the aid of a screw or the like. It is also possible that the base plate 15 or 11 can be adjusted in a conventional manner in longitudinal direction on the ski to compensate for different sized ski boots.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding, comprising:

base plate means adapted to be fixedly secured to the upper surface of a ski, said base plate means having first and second abutment members thereon longitudinally spaced from one another in a direction parallel to the longitudinal axis of said ski;

toe binding means adapted to releasably engage the toe portion of a ski boot and first support means for supporting said toe binding means on said base plate means for movement relative to said base plate means in a direction parallel to said longitudinal axis of said ski, said toe binding means having release means thereon which includes a first spring support member movable with said toe binding means and a first release spring, said first release spring extending between said first abutment member and said spring support;

heel binding means adapted to releasably engage the heel portion of said ski boot and second support means for supporting said heel binding means on said base plate means spaced longitudinally from said toe binding means and for movement relative to said base plate means in a direction parallel to said longitudinal axis of said ski, said heel binding means having second release means thereon which includes a control cam movable with said heel binding means and a second release spring, said second release spring extending between said second abutment member and said control cam;

first stop means for limiting the movement of said heel binding means away from said toe binding means;

first resilient means for urging said heel binding means toward said toe binding means;

second resilient means for urging said toe binding means towards said heel binding means for assuring at least a movement of said heel binding means into engagement with said first stop means against the urging of said first resilient means in response to an insertion of said ski boot between said toe binding means and said heel binding means; and at least one of said first and second release springs being located on the side of the related abutment member towards the tip of the ski for facilitating, during a longitudinal movement of at least one of said toe binding means and said heel binding means relative to said ski during skiing, a reduction of the amount of spring force in said at least one of said first and second release springs that is being utilized to releasably hold said ski boot in said toe binding means and in said heel binding means to thereby facilitate an easy release of said ski boot from between said toe binding means and said heel binding means.

2. The ski binding according to claim 1, wherein said first and second support means are each a carriage reciprocally movably mounted on said base plate means.

3. The ski binding according to claim 1, including second stop means for limiting the movement of said toe binding means toward said heel binding means, said second resilient means urging said toe binding means into engagement with said second stop means.

4. The ski binding according to claim 3, wherein said first release spring is positioned on a side of said first abutment member opposite said ski boot and said second release spring is positioned on the same side of said second abutment member as said ski boot, whereby a longitudinal movement of said toe binding means and said heel binding toward the tip of said ski against the urging of said first and second resilient means will occur when said ski encounters a frontal object and said spring force of said first and second release springs will both be reduced thereby facilitating an easy release of said ski boot.

5. The ski binding according to claim 3, wherein said first and second resilient means are springs, said second resilient means having a stronger spring return force than said first resilient means.

* * * * *